US008922602B2

(12) United States Patent
Choi et al.

(10) Patent No.: US 8,922,602 B2
(45) Date of Patent: Dec. 30, 2014

(54) METHOD OF DRIVING DISPLAY PANEL AND DISPLAY APPARATUS FOR PERFORMING THE SAME

(75) Inventors: Jae-Suk Choi, Uijeongbu-Si (KR); Yong-Jun Choi, Asan-Si (KR); Woo-Jin Jung, Seoul (KR)

(73) Assignee: Samsung Display Co., Ltd., Yongin, Gyeonggi-Do (KR)

( * ) Notice: Subject to any disclaimer, the term of this patent is extended or adjusted under 35 U.S.C. 154(b) by 294 days.

(21) Appl. No.: 13/243,014

(22) Filed: Sep. 23, 2011

(65) Prior Publication Data

US 2012/0249620 A1 Oct. 4, 2012

(30) Foreign Application Priority Data

Mar. 28, 2011 (KR) ..... 10-2011-0027395

(51) Int. Cl.
*G09G 5/02* (2006.01)
*G09G 3/36* (2006.01)
*G09G 5/06* (2006.01)

(52) U.S. Cl.
CPC ..... *G09G 3/3648* (2013.01); *G09G 5/06* (2013.01); *G09G 2320/0219* (2013.01); *G09G 3/3688* (2013.01)
USPC ..... 345/694; 345/89

(58) Field of Classification Search
CPC ..... G09G 5/10; G09G 3/36; G09G 5/02
See application file for complete search history.

(56) References Cited

U.S. PATENT DOCUMENTS 7,365,722 B2 * 4/2008 Lee ..... 345/88
2009/0244109 A1 * 10/2009 Chen et al. ..... 345/690

* cited by examiner

*Primary Examiner* — William Boddie
*Assistant Examiner* — Bryan Earles
(74) *Attorney, Agent, or Firm* — F. Chau & Associates, LLC

(57) ABSTRACT

A display apparatus includes a display panel, a timing controller, data and gate driving parts. The display panel includes first and second substrates, and a liquid crystal layer disposed between the first and second substrates, and displays an image. The timing controller includes a data compensating unit that outputs compensated grayscale data in an n-th pixel row, based upon a coupling capacitance generated according to a grayscale data variation between an (n−1)-th pixel row and the n-th pixel row, n' being a natural number. The data driving part converts the compensated grayscale data to an analog data voltage, and outputs the analog data voltage to data lines.

14 Claims, 6 Drawing Sheets

| | DL1 | DL2 | DL3 | DL4 | ··· | DLi |
|---|---|---|---|---|---|---|
| DATA1(n-1) | 800 | 155 | 900 | 400 | ··· | 0 |
| DATA1(n) | 500 | 1023 | 228 | 710 | ··· | 800 |
| COUPLING | -300 | 868 | -672 | 310 | ··· | 800 |
| Cc=SUM OF COUPLING/ixCOUPLING CONSTANT | | | | | | |

FIG. 4

| Cc | DATA1(n) | | | | | | | | | | |
|---|---|---|---|---|---|---|---|---|---|---|---|
| | 0 | 1 | 2 | 3 | 4 | ··· | B | ··· | 253 | 254 | 255 |
| -255 | | | | | | | | | | | |
| -254 | | | | | | | | | | | |
| -253 | | | | | | | | | | | |
| ⋮ | | | | | | | | | | | |
| A | | | | | | | C | | | | |
| ⋮ | | | | | | | | | | | |
| 0 | | | | | | | | | | | |
| ⋮ | | | | | | | | | | | |
| 253 | | | | | | | | | | | |
| 254 | | | | | | | | | | | |
| 255 | | | | | | | | | | | |

METHOD OF DRIVING DISPLAY PANEL AND DISPLAY APPARATUS FOR PERFORMING THE SAME

CROSS-REFERENCE TO RELATED APPLICATION

This application claims under 35 U.S.C. §119 priority to and the benefit of Korean Patent Application No. 2011-27395, filed on Mar. 28, 2011 in the Korean Intellectual Property Office (KIPO), the entire content of which is incorporated by reference herein.

BACKGROUND

1. Field of the Invention

The present disclosure relates to a method of driving a display panel and a display apparatus for performing the method, and, more particularly, to a method of driving a display panel applied to a liquid crystal display (LCD) apparatus and a display apparatus for performing the method.

2. Discussion of the Related Art

In general, an LCD apparatus includes an LCD panel, a data driving part and a gate driving part. The LCD panel includes an array substrate, a color filter substrate and a liquid crystal layer therebetween.

The array substrate includes data lines, gate lines, switching elements and pixel electrodes. For example, the array substrate includes I×J switching elements electrically connected to I data lines and J gate lines respectively, and I×J pixel electrodes electrically connected to the corresponding switching elements. Here, 'I' and 'J' are natural numbers.

The color filter substrate includes color filters and a common electrode. Accordingly, the LCD panel includes I×J pixels. The data driving part provides a data voltage to the I data lines, and the gate driving part sequentially provides J gate signals to the J gate lines. The LCD panel including I×J pixels is driven by the provided data voltages and gate signals.

Recently, technologies for driving the LCD panel with a high speed frame frequency having increased frame rates have been applied to prevent video motion blur from occurring. In this case, the time (H: horizontal period) for recharging the pixel with a data voltage will be decreased.

In addition, the cell gap between the array substrate and the color filter substrate has been decreased to enhance the liquid crystal response rate. Accordingly, a coupling capacitance is generated between the pixel electrode to which the data voltage is applied and the common electrode facing the pixel electrode, so that a common voltage applied to the common electrode can become distorted.

In this case, the time period for recharging the pixel may be longer than the usual horizontal period time due to the distorted common voltage. Accordingly, since the pixel electrode is not fully recharged, deterioration of display quality, such as reddishness, horizontal stripes, a crosstalk, and the like, can occur.

Although a method of configuring a feedback reversed compensating circuit can be provided to compensate the distorted common voltage, the RC load of a panel is increased, and compensating charges become insufficient when the horizontal period 1H is relatively short.

SUMMARY

In accordance with an example embodiments of the present invention a method of driving a display panel that compensates for coupling capacitance, and a display apparatus for performing the method, are provided.

In accordance with an example embodiment, a method of driving a display panel for displaying an image is provided, the display panel having a first substrate, a second substrate and a liquid crystal layer disposed between the first substrate and the second substrate, the first substrate having data lines, gate lines crossing the data lines and a plurality of pixels electrically connected to the data lines and to the gate lines, the second substrate having a common electrode facing the pixels. Compensated grayscale data for an n-th pixel row is outputted based upon a grayscale data variation between an (n−1)-th pixel row and the n-th pixel row. The compensated grayscale data is converted to an analog data voltage to output the analog data voltage to the data lines. A gate signal is outputted through the gate lines to provide the gate signal to the display panel.

In an example embodiment, outputting compensated grayscale data in the n-th pixel row may include storing grayscale data for the (n−1)-th pixel row and the grayscale data for the n-th pixel row, calculating a coupling capacitance generated between the pixels and the common electrode based upon the grayscale data variation between the (n−1)-th pixel row and the n-th pixel row, and outputting the compensated grayscale data in the n-th pixel row based upon the coupling capacitance.

In an example embodiment, calculating the coupling capacitance may include outputting digital data respectively corresponding to analog data voltages of the grayscale data in the (n−1)-th and n-th pixel rows based upon a one-dimensional look-up table to which the digital data corresponding to the analog data voltages of the grayscale data are mapped, calculating a sum of the coupling capacitances by summing values of a result from subtracting the digital data of the (n−1)-th pixel row from the digital data of the n-th pixel row in each of the data lines, and dividing the sum by the amount of the data lines and multiplying the divided value by a coupling constant.

In an example embodiment, outputting the compensated grayscale data in the n-th pixel row may include outputting adjusted data of the n-th pixel row based upon a two-dimensional look-up table to which the adjusted data of the n-th pixel row corresponding to the coupling capacitance and the grayscale data of the n-th pixel row are mapped, and calculating the compensated grayscale data of the n-th pixel row by subtracting the adjusted data from the grayscale data of the n-th pixel row or by adding the adjusted data to the grayscale data of the n-th pixel row.

In an example embodiment, calculating the compensated grayscale data of the n-th pixel row may further include subtracting the adjusted data from the grayscale data of the n-th pixel row when the coupling capacitance has a positive polarity, and by adding the adjusted data to the grayscale data of the n-th pixel row when the coupling capacitance has a negative polarity.

In an example embodiment, outputting the compensated grayscale data in the n-th pixel row may further include outputting the adjusted data of the n-th pixel row as a bypass value when the coupling capacitance is not more than a reference value.

In an example embodiment, outputting the compensated grayscale data in the n-th pixel row may further include recalculating the coupling capacitance based upon a feeding back of the compensated grayscale data of the n-th pixel row.

In an example embodiment, feeding back the compensated grayscale data of the n-th pixel row and recalculating the coupling capacitance may be repeated.

According to an example embodiment, a display apparatus includes a display panel configured to display an image. The display panel includes a first substrate, a second substrate, and a liquid crystal layer disposed between the first substrate and the second substrate. The first substrate includes data lines, gate lines crossing the data lines and a plurality of pixels, the pixels being electrically connected to the data and gate lines and being arranged in a matrix shape, the second substrate having a common electrode facing the pixels. A timing controller includes a data compensating unit, the data compensating unit outputting compensated grayscale data in an n-th pixel row based upon a coupling capacitance generated according to a grayscale data variation between an (n−1)-th pixel row and the n-th pixel row. A data driving part converts the compensated grayscale data to an analog data voltage, and outputs the analog data voltage to the data lines. A gate driving part outputs a gate signal to the gate lines.

In an example embodiment, the data compensating unit may include an inner storage unit configured to store the grayscale data of the (n−1)-th pixel row and the grayscale data of the n-th pixel row, a coupling capacitance calculating unit configured to calculate coupling capacitance generated between the pixels and the common electrode based upon a grayscale data variation between the (n−1)-th pixel row and the n-th pixel row, a data adjusting unit configured to output compensated grayscale data of the n-th pixel row based upon the coupling capacitance.

In an example embodiment, the coupling capacitance calculating unit may include a one-dimensional look-up table to which the digital data respectively corresponding to the analog data voltages of the grayscale data in the (n−1)-th and n-th pixel rows are mapped.

In an example embodiment, the coupling capacitance calculating unit may calculate the coupling capacitance by summing values resulting from subtracting the digital data of the (n−1)-th pixel row from the digital data of the n-th pixel row in each of the data lines, and by dividing the sum by the amount of the data lines and multiplying the divided value by a coupling constant.

In an example embodiment, the data adjusting unit may include a two-dimensional look-up table to which the adjusted data of the n-th pixel row corresponding to the coupling capacitance and the grayscale data of the n-th pixel row are mapped.

In an example embodiment, the data adjusting unit may calculate the compensated grayscale data of the n-th pixel row by subtracting the adjusted data from the grayscale data of the n-th pixel row or by adding the adjusted data to the grayscale data of the n-th pixel row.

In an example embodiment, the data adjusting unit may calculate the compensated grayscale data of the n-th pixel row, by subtracting the adjusted data from the grayscale data of the n-th pixel row, when the coupling capacitance has a positive polarity, and by adding the adjusted data to the grayscale data of the n-th pixel row, when the coupling capacitance has a negative polarity.

In an example embodiment, the data adjusting unit may feed the compensated grayscale data of the n-th pixel row back to the coupling capacitance calculating unit and recalculate the coupling capacitance based upon the compensated grayscale data of the n-th pixel row.

In an example embodiment, the inner storage unit may be a line buffer and may calculate the coupling capacitance is repeated as many as the amount of line buffers.

In an example embodiment, the data compensating unit may further include a bypass unit configured to directly output the grayscale data of the n-th pixel row to the data driving part when the coupling capacitance is not more than a reference value.

In an example embodiment, pixels of the (n−1)-th pixel row may be electrically connected to first sides of the data lines, and pixels of the n-th pixel row may be electrically connected to second sides of the data lines, respectively.

In an example embodiment, the pixels may include red pixels, green pixels, blue pixels and white pixels.

According to an example embodiment, a method for preventing distortion of a common voltage applied to a common electrode of a liquid crystal display panel having a plurality of pixel rows, is provided. A coupling capacitance between pixel electrodes to which grayscale data is applied and a common electrode facing the pixel electrodes is determined, based upon grayscale data variations between the pixel electrodes of a n-th pixel row and the common electrode and between pixel electrodes of a (n−1)-th pixel row and the common electrode. The grayscale data to be applied to the n-th pixel row is adjusted based upon the coupling capacitance.

BRIEF DESCRIPTION OF THE DRAWINGS

Detailed example embodiments of the present invention will now be described with reference to the accompanying drawings, in which:

FIG. 4 is a conceptual diagram illustrating a two-dimensional (2D) look-up table of a data adjusting unit in FIG. 2;

DETAILED DESCRIPTION

Hereinafter, example embodiments of the present invention will be explained in detail with reference to the accompanying drawings.

Figure 1:
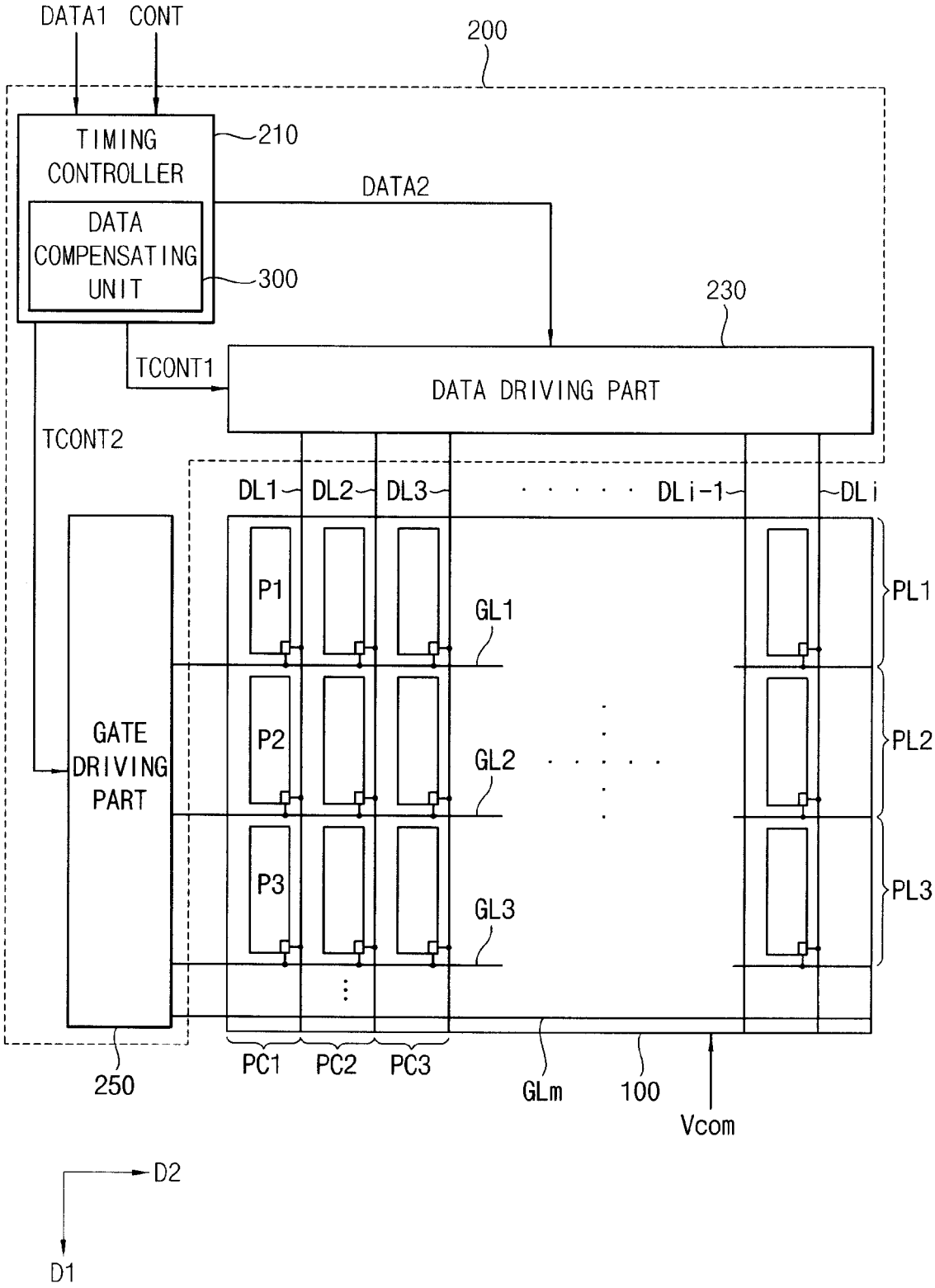
FIG. 1 is a block diagram illustrating a display apparatus according to an example embodiment of the present invention.

FIG. 1 is a block diagram illustrating a display apparatus according to an example embodiment of the present invention.

Referring to FIG. 1, the display apparatus includes a display panel 100, and a panel driving part 200 that drives the display panel 100. The panel driving part 200 includes a timing controller 210, a data driving part 230 and a gate driving part 250. The panel driving part 200 drives the display panel 100 at a high frequency driving frequency. In an example embodiment, the display panel 100 is driven at a frequency not less than about 120 Hz, such as at 120 Hz or 240 Hz.

The display panel 100 includes an array substrate, an opposing substrate facing the array substrate, and a liquid crystal layer disposed between the array substrate and the opposing substrate. A plurality of pixels P1, P2, P3, . . . may be arranged in a matrix array of row and columns. The pixels P1, P2, P3, . . . may include red, green, and blue pixels, and may further include a white pixel. Color filters on the opposing substrate in conjunction with the liquid crystal layer can provide the desired colors.

The array substrate includes a plurality of data lines DL1, DL2, DL3, . . . DLi and a plurality of gate lines GL1, GL2, GL3, . . . GLm. The array substrate further includes switching elements electrically connected to the respective data lines and gate lines, and pixel electrodes electrically connected to the switching elements. In an example embodiment, the switching elements are thin film transistors (TFTs). The pixel electrode is disposed on a pixel area defined by each of the pixels of the array substrate.

The data lines DL1, DL2, DL3, . . . DLi extend along a first direction D1, and are arranged along a second direction D2 crossing the first direction D1. In an example embodiment the first direction D1 and the second direction D2 are substantially perpendicular to each other. The data lines DL1, DL2, DL3, . . . DLi are electrically connected to output terminals of the data driving part 230, respectively. Each of the data lines is electrically connected to the pixels of a pixel column arranged along the first direction D1. The gate lines GL1, GL2, GL3, . . . GLm extend along the second direction D2, and are arranged along the first direction D1.

Those skilled in the art can appreciate that the pixels, their data lines and gate lines can be arranged in other example geometries rather than merely in rectangular rows and columns. For example, pixels may be arranged in a delta formation such that red, green and blue sub-pixels can form a substantially triangular pixel. Such triangular pixels are particularly useful for displays having motion pictures.

The opposing substrate includes a common electrode facing the pixel electrodes. A common voltage Vcom, which is a reference voltage, is applied to the common electrode. The common voltage Vcom may be a DC voltage having a certain level.

The timing controller 210 controls the data driving part 230 and the gate driving part 250. The timing controller 210 receives image data DATA1 and a control signal CONT from outside the panel driving part, and generates a first timing control signal TCONT1 for controlling the driving timing of the data driving part 230, and a second timing control signal TCONT2 for controlling the driving timing of the gate driving part 250.

The first timing control signal TCONT1 may include a horizontal starting signal, an inversing signal, an output enable signal, and the line. The second timing control signal TCONT2 may include a vertical starting signal, a gate clock signal, an output enable signal, and the like.

The image data DATA1, which are grayscale data of an image, may be red, green, and blue data. The timing controller 210 provides the data driving part 230 in a horizontal period 1H unit with compensated grayscale data DATA2. The compensated grayscale data DATA2 compensates the grayscale data corresponding to the structure of the pixels of the display panel 100, as will be described in more detail below.

The data driving part 230 converts a data signal provided from the timing controller 210 to an analog data voltage, and outputs the analog data voltage to the data lines DL1, DL2, DL3, . . . DLi.

The gate driving part 250 generates a plurality of gate signals under the control of the timing controller 210, and sequentially provides the gate signals to the gate lines GL1, GL2, GL3, . . . GLm.

Each of the pixels may be a one gate line one data line (1G1D) structure electrically connected to a gate line and a data line. For example, pixels of a first pixel column PC1 are electrically connected to a first data line DL1, and pixels of a second pixel column PC2 are electrically connected to a second data line DL2. Accordingly, the pixels of one pixel column are electrically connected to the data line formed at a first side of the pixel column.

Pixels of a first pixel row PL1 are electrically connected to one of the data lines DL1, DL2, DL3, . . . DLi and a first gate line GL1. Pixels of a second pixel row PL2 are electrically connected to one of the data lines DL1, DL2, DL3, . . . DLi and a second gate line GL2. Pixels of a third pixel row PL3 are electrically connected to one of the data lines DL1, DL2, DL3, . . . DLi and a third gate line GL3.

When the data driving part 230 provides the data voltage to the data lines DL1, DL2, DL3, . . . DLi, the data voltage is applied to each of the pixel electrodes of the pixels electrically connected to the data lines DL1, DL2, DL3, . . . DLi. In this case, distortion of the common voltage Vcom applied to the common electrode occurs due to a coupling capacitance generated between the pixel electrode and the common electrode, such that display quality may decrease.

The timing controller 210 includes a data compensating unit 300. The data compensating unit 300 calculates a coupling capacitance, which is generated in advance according to a grayscale data variation between adjacent pixel rows. Then, the compensating unit 300 compensates grayscale data applied to the pixels of the present pixel row using the calculated coupling capacitance, and outputs the compensated grayscale data.

The data compensating unit 300 compensates the grayscale data in a digital format, which is different from a conventional analog format. The data compensating unit 300 will now be explained below in more detail.

Figures 2, 3:
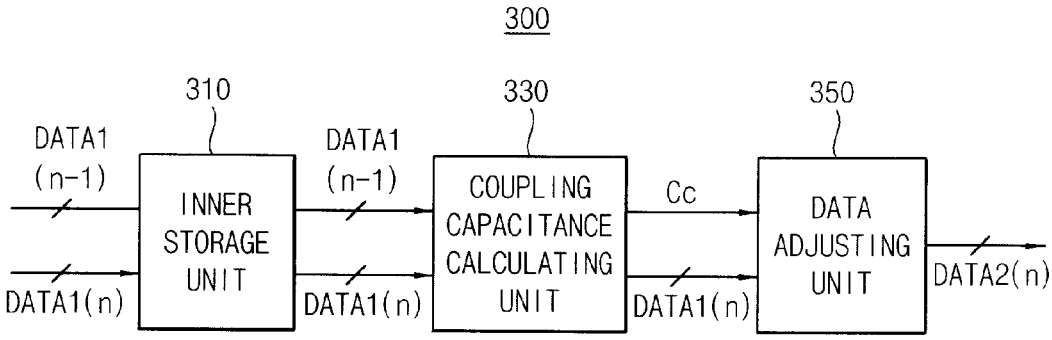
FIG. 2 is a block diagram illustrating a data compensating unit in FIG. 1.
FIG. 3 is a conceptual diagram illustrating how to calculate a coupling capacitance in a coupling capacitance calculating unit in FIG. 2.

FIG. 2 is a block diagram illustrating an example embodiment of the data compensating unit of FIG. 1. FIG. 3 is a conceptual diagram illustrating how coupling capacitance is calculated in the coupling capacitance calculating unit of FIG. 2. FIG. 4 is a conceptual diagram illustrating a two-dimensional (2D) look-up table of the data adjusting unit of FIG. 2.

Referring to FIGS. 2 to 4, the data compensating unit 300 includes an inner storage unit 310, a coupling capacitance calculating unit 330 and a data adjusting unit 350.

The inner storage unit 310 stores the grayscale data of the pixel rows. For example, when the data compensating unit 300 compensates grayscale data DATA1($n$) of a present pixel row, the inner storage unit 310 may store grayscale data DATA1($n$−1) of a previous pixel row and the grayscale data DATA1($n$) of the present pixel row. The inner storage unit 310 may be a line buffer, and may store grayscale data of at least two pixel rows.

The coupling capacitance calculating unit 330 calculates the coupling capacitance generated between the pixel electrode and the common electrode, according to the variation between the grayscale data DATA1($n$−1) of the previous pixel row and the grayscale data DATA1($n$) of the present pixel row.

For example, the coupling capacitance calculating unit 330 may calculate the coupling capacitance, in response to the inversing signal of the first timing controlling signal TCONT1.

The coupling capacitance calculating unit 330 includes a one-dimensional look-up table (1D LUT) to which digital data corresponding to the data voltage are mapped corresponding to the grayscale data.

The one-dimensional look-up table (1D LUT) converts the grayscale data such that the coupling capacitance calculating unit 330 linearly calculates the coupling capacitance. Grayscale data used in the timing controller 210 are digital signals, and the data voltage outputted from the data driving part and applied to the pixel electrodes, is an analog signal.

Accordingly, to calculate a coupling capacitance generated when the grayscale data are actually applied to the pixel electrode as the data voltage, the grayscale data are converted to digital data corresponding to the data voltage.

The coupling capacitance calculating unit 330 adds values resulting from subtracting the grayscale data DATA1($n$−1) of the previous pixel row from the grayscale data DATA1($n$) of the present pixel row in each of the data lines.

For example, as shown in FIG. 3, the grayscale data DATA1($n$) of the present pixel row connected to a first data line DL1 is converted into digital data corresponding to the data voltage, and the converted digital data value is 500. The grayscale data DATA1($n$−1) of the previous pixel row connected to the first data line DL1 is converted as the digital data corresponding to the data voltage, and the converted digital data value is 800. Accordingly, the coupling capacitance generated in the first data line DL1 is −300, which is the result of the subtraction of 800 from 500.

Similarly, the coupling capacitance calculating unit 330 calculates coupling capacitances respectively generated in the data lines DL1, DL2, DL3, . . . DLi. The coupling capacitance calculating unit 330 calculates the sum of the coupling capacitances. The sum of the coupling capacitances is then divided by the amount of the data lines DL1, DL2, DL3, . . . DLi, and multiplied by a coupling constant, so that a coupling capacitance Cc may be calculated.

For example, when the display apparatus is a HDTV having 1920×1080 pixels, the amount of data lines DL1, DL2, DL3, . . . DLi is 5760, which is the multiplication of 1920 pixels by 3 sub-pixels for the red, green and blue sub-pixel colors per pixel. The coupling constant transforms the coupling capacitance calculated from the digital data to an actual coupling capacitance.

The data adjusting unit 350 outputs compensated grayscale data DATA2($n$) of the grayscale data DATA1($n$) of the present pixel row to compensate for the coupling capacitance Cc calculated in the coupling capacitance calculating unit 330.

The data adjusting unit 350 may include a two-dimensional look-up table (2D LUT) to which adjusted data of an n-th pixel row, corresponding to the coupling capacitance Cc and the grayscale data DATA1($n$) of the present pixel row, are mapped. The adjusted data compensates the grayscale data DATA1($n$) of the present pixel row to compensate for the coupling capacitance Cc. The adjusted data are calculated according to the coupling capacitance Cc in advance, and are stored. The adjusted data may be greater than 0.

For example, as shown in FIG. 4, the coupling capacitance Cc is scaled as 9 bits, and is arranged in rows of the mapping, and the grayscale data DATA1($n$) of the present pixel row is arranged in columns of the mapping.

For example, when the coupling capacitance Cc is "A", and the grayscale data DATA1($n$) of the present pixel row is "B", "C" mapped corresponding to the "A" and "B" is adjusted data of the grayscale data DATA1($n$) of the present pixel row.

The data adjusting unit 350 outputs the compensated grayscale data DATA2($n$) of the grayscale data DATA1($n$) of the present pixel row calculated by subtracting the adjusted data from the grayscale data DATA1($n$) of the present pixel row or by adding the adjusted data to the grayscale data DATA1($n$) of the present pixel row.

For example, when the coupling capacitance Cc has a positive polarity, the data adjusting unit 350 may output the compensated grayscale data DATA2($n$) of the grayscale data DATA1($n$) of the present pixel row calculated by subtracting the adjusted data from the grayscale data DATA1($n$) of the present pixel row. Alternatively, when the coupling capacitance Cc has a negative polarity, the data adjusting unit 350 may output the compensated grayscale data DATA2($n$) of the grayscale data DATA1($n$) of the present pixel row calculated by adding the adjusted data to the grayscale data DATA1($n$) of the present pixel row.

The data adjusting unit 350 provides the data driving part 230 with the compensated grayscale data DATA2($n$) of the present pixel row, and the data driving part 230 converts the compensated grayscale data DATA2($n$) of the present pixel row to the analog data voltage, and then outputs the analog data voltage to the data lines DL1, DL2, DL3, . . . DLi to drive the display panel.

According to the present example embodiment, the data compensating unit 300 calculates the coupling capacitance, which is generated according to grayscale data variation between adjacent pixel rows, in advance. Then, the compensating unit 300 compensates the grayscale data applied to the pixels of the adjacent pixel rows based upon the calculated coupling capacitance, and outputs the compensated grayscale data. Accordingly, a deterioration of a display quality such as reddish, horizontal stripes, crosstalk, and the like, may be prevented.

Figure 5:
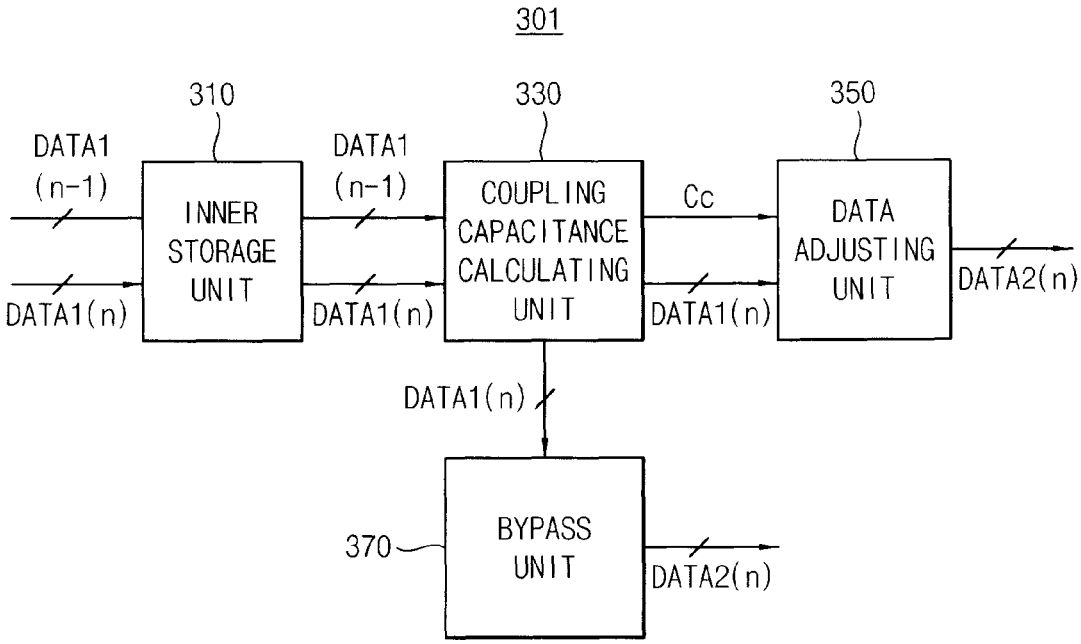
FIG. 5 is a block diagram illustrating a data compensating unit of a display apparatus according to another example embodiment of the present invention.

FIG. 5 is a block diagram illustrating a data compensating unit of a display apparatus according to an example embodiment of the present invention.

Referring to FIG. 5, the data compensating unit 301 of the display apparatus according to the present example embodiment is substantially the same as the compensating unit 300 of FIG. 2, except that the data compensating unit 301 further includes a bypass unit 370. Accordingly, the same reference numerals will be used to refer to the same or like parts as the data compensating unit 300 illustrated in FIG. 2 and any further repetitive explanation concerning the same or like parts will be omitted.

The data compensating unit 301 of the display apparatus includes an inner storage unit 310, a coupling capacitance calculating unit 330, a data adjusting unit 350 and a bypass unit 370.

The inner storage unit 310 stores grayscale data of the pixel rows. For example, when the data compensating unit 301 compensates grayscale data DATA1($n$) of a present pixel row, the inner storage unit 310 may store grayscale data DATA1($n$−1) of a previous pixel row, and the grayscale data DATA1($n$) of the present pixel row. The inner storage unit 310 may be a line buffer, and may store grayscale data of at least two pixel rows.

The coupling capacitance calculating unit 330 calculates the coupling capacitance generated between the pixel electrode and the common electrode, according to the variation between the grayscale data DATA1($n$−1) of the previous pixel row and the grayscale data DATA1($n$) of the present pixel row.

The coupling capacitance calculating unit 330 may include a one-dimensional look-up table (1D LUT) to which digital data corresponding to the data voltage are mapped corresponding to the grayscale data.

The coupling capacitance calculating unit 330 compares the calculated coupling capacitance Cc to a reference value, and determines whether or not the grayscale data DATA1($n$) of the present pixel row need to be compensated.

For example, when the coupling capacitance Cc is not more than the reference value, the coupling capacitance calculating unit 330 may determine that compensating the grayscale data DATA1($n$) of the present pixel row is unnecessary, but when the coupling capacitance Cc is larger than the reference value, the coupling capacitance calculating unit 330 may determine that compensating the grayscale data DATA1(*n*) of the present pixel row is necessary.

When compensating the grayscale data DATA1(*n*) of the present pixel row is determined to be unnecessary, the coupling capacitance calculating unit 330 may output the grayscale data DATA1(*n*) of the present pixel row to the bypass unit 370.

Alternatively, when compensating the grayscale data DATA1(*n*) of the present pixel row is determined to be necessary, the coupling capacitance calculating unit 330 may output the grayscale data DATA1(*n*) of the present pixel row to the data adjusting unit 350.

The data adjusting unit 350 outputs compensated grayscale data DATA2(*n*) of the grayscale data DATA1(*n*) of the present pixel row to compensate for the coupling capacitance Cc calculated in the coupling capacitance calculating unit 330.

The data adjusting unit 350 may include a two-dimensional look-up table (2D LUT) to which adjusted data of an n-th pixel row, corresponding to the coupling capacitance Cc and the grayscale data DATA1(*n*) of the present pixel row, are mapped.

The adjusted data compensates the grayscale data DATA1(*n*) of the present pixel row to compensate for the coupling capacitance Cc. The adjusted data are calculated according to the coupling capacitance Cc in advance, and are stored. The adjusted data may be larger than 0.

The data adjusting unit 350 outputs the compensated grayscale data DATA2(*n*) of the grayscale data DATA1(*n*) of the present pixel row calculated by subtracting the adjusted data from the grayscale data DATA1(*n*) of the present pixel row, or by adding the adjusted data to the grayscale data DATA1(*n*) of the present pixel row.

For example, when the coupling capacitance Cc has a positive polarity, the data adjusting unit 350 may output the compensated grayscale data DATA2(*n*) of the grayscale data DATA1(*n*) of the present pixel row calculated by subtracting the adjusted data from the grayscale data DATA1(*n*) of the present pixel row. Alternatively, when the coupling capacitance Cc has a negative polarity, the data adjusting unit 350 may output the compensated grayscale data DATA2(*n*) of the grayscale data DATA1(*n*) of the present pixel row calculated by adding the adjusted data to the grayscale data DATA1(*n*) of the present pixel row.

When the coupling capacitance Cc calculated in the coupling capacitance calculating unit 330 is too small to affect a display quality, the bypass unit 370 omits compensating the grayscale data DATA1(*n*) of the present pixel row.

When compensating the grayscale data DATA1(*n*) of the present pixel row is determined to be unnecessary, the coupling capacitance calculating unit 330 outputs the grayscale data DATA1(*n*) of the present pixel row to the bypass unit 370.

The bypass unit 370 may directly output the grayscale data DATA1(*n*) of the present pixel row to the data driving part 230. Alternatively, the bypass unit 370 may set up the adjusted data of the grayscale data DATA1(*n*) of the present pixel row to be a bypass value, for example, 0. In this case, the compensated grayscale data DATA2(*n*) of the present pixel row may be substantially same as the grayscale data DATA1(*n*) of the present pixel row.

According to the present example embodiment, the data compensating unit 301 includes the bypass unit 370 omitting compensating grayscale data when compensating the coupling capacitance is unnecessary, so that the coupling capacitance is efficiently compensated.

Figure 6:
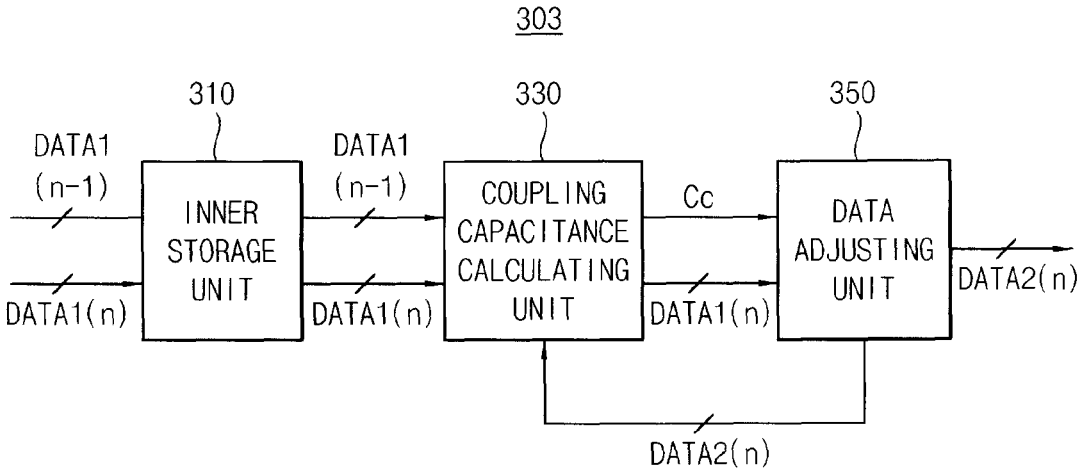
FIG. 6 is a block diagram illustrating a data compensating unit of a display apparatus according to still another example embodiment of the present invention.

FIG. 6 is a block diagram illustrating a data compensating unit of a display apparatus according to an example embodiment of the present invention.

Referring to FIG. 6, the data compensating unit 303 of the display apparatus according to the present example embodiment is substantially the same as the compensating unit 300 of FIG. 2, except that compensated grayscale data are fed back to a coupling capacitance calculating unit. Accordingly, the same reference numerals will be used to refer to the same or like parts as the data compensating unit 300 illustrated in FIG. 2 and any further repetitive explanation concerning the same or like parts will be omitted.

The compensating unit 303 of the display apparatus according to the present example embodiment includes an inner storage unit 310, a coupling capacitance calculating unit 330 and a data adjusting unit 350.

The inner storage unit 310 stores grayscale data of the pixel rows. For example, when the data compensating unit 303 compensates grayscale data DATA1(*n*) of a present pixel row, the inner storage unit 310 may store grayscale data DATA1(*n*−1) of a previous pixel row and the grayscale data DATA1(*n*) of the present pixel row. The inner storage unit 310 may be a line buffer, and may store grayscale data of at least two pixel rows.

The coupling capacitance calculating unit 330 calculates the coupling capacitance generated between the pixel electrode and the common electrode, according to the variation between the grayscale data DATA1(*n*−1) of the previous pixel row and the grayscale data DATA1(*n*) of the present pixel row.

The coupling capacitance calculating unit 330 may include a one-dimensional look-up table (1D LUT) to which digital data corresponding to the data voltage are mapped corresponding to the grayscale data.

The data adjusting unit 350 outputs compensated grayscale data DATA2(*n*) of the grayscale data DATA1(*n*) of the present pixel row to compensate for the coupling capacitance Cc calculated in the coupling capacitance calculating unit 330.

The data adjusting unit 350 may include a two-dimensional look-up table (2D LUT) to which adjusted data of an n-th pixel row, corresponding to the coupling capacitance Cc and the grayscale data DATA1(*n*) of the present pixel row, are mapped.

The adjusted data compensates the grayscale data DATA1(*n*) of the present pixel row to compensate for the coupling capacitance Cc. The adjusted data are calculated according to the coupling capacitance Cc in advance, and are stored. The adjusted data may be larger than 0.

The data adjusting unit 350 outputs the compensated grayscale data DATA2(*n*) of the grayscale data DATA1(*n*) of the present pixel row calculated by subtracting the adjusted data from the grayscale data DATA1(*n*) of the present pixel row, or by adding the adjusted data to the grayscale data DATA1(*n*) of the present pixel row.

For example, when the coupling capacitance Cc has a positive polarity, the data adjusting unit 350 may output the compensated grayscale data DATA2(*n*) of the grayscale data DATA1(*n*) of the present pixel row calculated by subtracting the adjusted data from the grayscale data DATA1(*n*) of the present pixel row. Alternatively, when the coupling capacitance Cc has a negative polarity, the data adjusting unit 350 may output the compensated grayscale data DATA2(*n*) of the grayscale data DATA1(*n*) of the present pixel row calculated by adding the adjusted data to the grayscale data DATA1(*n*) of the present pixel row.

The data adjusting unit 350 feeds the compensated grayscale data DATA2(*n*) of the present pixel row back to the coupling capacitance calculating unit 330. The coupling capacitance calculating unit 330 recalculates the coupling capacitance according to the variation between the grayscale data DATA1($n$−1) of the previous pixel row and the compensated grayscale data DATA2($n$) of the present pixel row.

The coupling capacitance, which is actually generated in the display panel 100, may be changed according to the compensated grayscale data DATA2($n$) of the present pixel row calculated from the grayscale data DATA1($n$) of the present pixel row. Accordingly, an error may be decreased by recalculating the coupling capacitance based upon the compensated grayscale data DATA2($n$) of the present pixel row.

A feedback into the coupling capacitance calculating unit 330, and recalculating the coupling capacitance may be repeated. For example, the amount of the feedback and recalculating may be as many as the amount of added line buffers used for the inner storage unit 310. For example, when the amount of the line buffers is two, one feedback may be possible, and when the amount of the line buffers is three, two feedbacks may be possible.

According to the present example embodiment, the compensated grayscale data DATA2($n$) of the present pixel row are fed back to the coupling capacitance calculating unit 330 and the coupling capacitance is recalculated, so that an error may be decreased.

Figure 7:
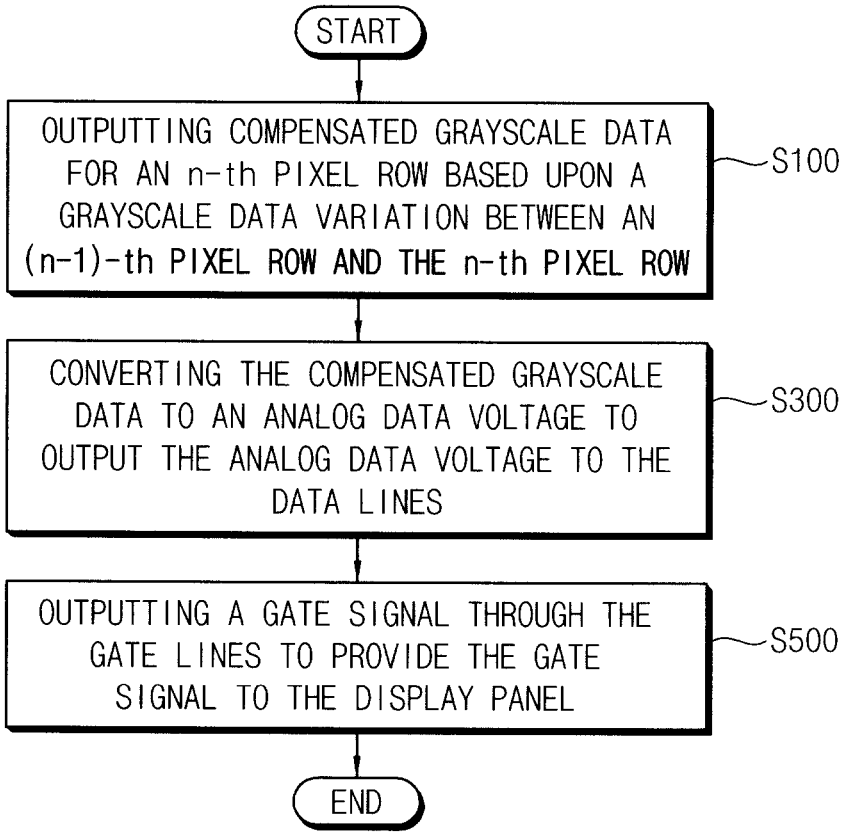
FIGS. 7 and 8 are flow charts illustrating a method of driving a display panel described in FIG. 1.
Figure 8:
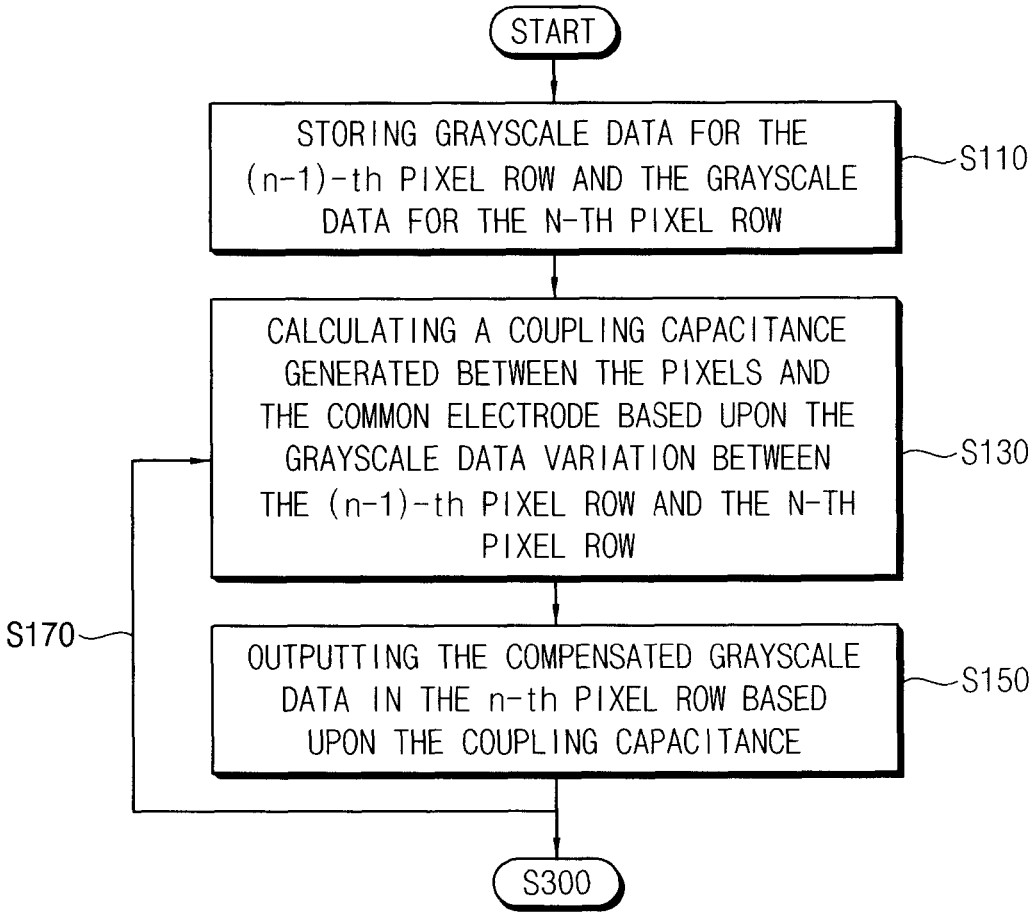

FIGS. 7 and 8 are flow charts illustrating a method of driving a display panel described in FIG. 1.

Referring to FIGS. 7 and 8, a method of driving the display panel displaying an image is explained. The display panel includes an array substrate, an opposing substrate facing the array substrate, and a liquid crystal layer disposed between the array substrate and the opposing substrate. The array substrate includes data lines DL1, DL2, DL3, . . . DLi and gate lines GL1, GL2, GL3, . . . GLm crossing the data lines DL1, DL2, DL3, . . . DLi, and a plurality of pixels P1, P2, P3, . . . electrically connected to the data lines DL1, DL2, DL3, . . . DLi and the gate lines GL1, GL2, GL3, . . . GLm respectively and arranged in a matrix shape. The opposing substrate includes common electrodes facing the pixels P1, P2, P3, . . . .

Referring to FIGS. 7 and 8, the data compensating unit 300 of the timing controller 210 calculates a coupling capacitance, which is generated according to a grayscale data variation between adjacent pixel rows in advance. Then, the compensating unit 300 compensates grayscale data applied to the pixels of the adjacent pixel rows based upon the calculated coupling capacitance, and outputs the compensated grayscale data (STEP S100).

For example, the inner storage unit 310 stores grayscale data of the pixel rows (STEP S110). When grayscale data of a present pixel row is compensated, the inner storage unit 310 may store grayscale data DATA1($n$−1) of a previous pixel row and the grayscale data DATA1($n$) of the present pixel row. The inner storage unit 310 may be a line buffer, and may store grayscale data of at least two pixel rows.

The coupling capacitance calculating unit 330 calculates the coupling capacitance generated between the pixel electrode and the common electrode, according to the variation between the grayscale data DATA1($n$−1) of the previous pixel row and the grayscale data DATA1($n$) of the present pixel row (STEP S130).

For example, the coupling capacitance calculating unit 330 may calculate the coupling capacitance, in response to the inversing signal of the first timing controlling signal TCONT1.

The coupling capacitance calculating unit 330 may include a one-dimensional look-up table (1D LUT) to which digital data corresponding to the data voltage are mapped corresponding to the grayscale data.

The one-dimensional look-up table (1D LUT) converts the grayscale data so that the coupling capacitance calculating unit 330 linearly calculates the coupling capacitance. Grayscale data used in the timing controller 210 are digital signals, and the data voltage outputted from the data driving part and applied to the pixel electrodes is an analog signal.

Accordingly, to calculate a coupling capacitance generated when the grayscale data is actually applied to the pixel electrode as the data voltage, the grayscale data are converted to digital data corresponding to the data voltage.

The coupling capacitance calculating unit 330 adds the resulting values of subtracting the grayscale data DATA1($n$−1) of the previous pixel row from the converted grayscale data DATA1($n$) of the present pixel row in each of the data lines.

The coupling capacitance calculating unit 330 calculates coupling capacitances generated in each of the data lines DL1, DL2, DL3, . . . DLi. Then, the coupling capacitance calculating unit 330 calculates the sum of the coupling capacitances. The sum of the coupling capacitances is divided by the amount of the data lines DL1, DL2, DL3, . . . DLi and multiplied by a coupling constant, so that a coupling capacitance Cc may be calculated.

For example, when the display apparatus is a HDTV having 1920×1080 pixels, the amount of data lines DL1, DL2, DL3, . . . DLi may be 5760, which is the multiplication of 1920 by 3. The coupling constant transforms the coupling capacitance calculated from the digital data to an actual coupling capacitance.

The data adjusting unit 350 outputs compensated grayscale data DATA2($n$) of the grayscale data DATA1($n$) of the present pixel row to compensate for the coupling capacitance Cc calculated in the coupling capacitance calculating unit 330 (STEP S150).

The data adjusting unit 350 may include a two-dimensional look-up table (2D LUT) to which adjusted data of an n-th pixel row, corresponding to the coupling capacitance Cc and the grayscale data DATA1($n$) of the present pixel row, are mapped.

The adjusted data compensates the grayscale data DATA1($n$) of the present pixel row to compensate for the coupling capacitance Cc. The adjusted data are calculated according to the coupling capacitance Cc in advance, and are stored. The adjusted data may be larger than 0.

The data adjusting unit 350 outputs the compensated grayscale data DATA2($n$) of the grayscale data DATA1($n$) of the present pixel row calculated by subtracting the adjusted data from the grayscale data DATA1($n$) of the present pixel row, or by adding the adjusted data to the grayscale data DATA1($n$) of the present pixel row.

For example, when the coupling capacitance Cc has a positive polarity, the data adjusting unit 350 may output the compensated grayscale data DATA2($n$) of the grayscale data DATA1($n$) of the present pixel row calculated by subtracting the adjusted data from the grayscale data DATA1($n$) of the present pixel row. Alternatively, when the coupling capacitance Cc has a negative polarity, the data adjusting unit 350 may output the compensated grayscale data DATA2($n$) of the grayscale data DATA1($n$) of the present pixel row calculated by adding the adjusted data to the grayscale data DATA1($n$) of the present pixel row.

The coupling capacitance calculating unit 330 compares the calculated coupling capacitance Cc to a reference value, and determines whether or not the grayscale data DATA1($n$) of the present pixel row needs to be compensated. When the coupling capacitance is not more than the reference value and thus the grayscale data DATA1($n$) of the present pixel row is unnecessary to be compensated, the coupling capacitance calculating unit 330 may output the grayscale data DATA1($n$) of the present pixel row to the bypass unit 370.

The bypass unit 370 may directly output the grayscale data DATA1($n$) of the present pixel row to the data driving part 230. Alternatively, the bypass unit 370 may set up the adjusted data of the grayscale data DATA1($n$) of the present pixel row to be a bypass value, for example, 0. In this case, the compensated grayscale data DATA2($n$) of the present pixel row may be substantially same as the grayscale data DATA1($n$) of the present pixel row.

The data adjusting unit 350 feeds the compensated grayscale data DATA2($n$) of the present pixel row back to the coupling capacitance calculating unit 330 (STEP 170). The coupling capacitance calculating unit 330 recalculates the coupling capacitance according to a variation between the grayscale data DATA1($n-1$) of the previous pixel row and the compensated grayscale data DATA2($n$) of the present pixel row.

The coupling capacitance, which is actually generated in the display panel 100, may be changed according to the compensated grayscale data DATA2($n$) of the present pixel row calculated from the grayscale data DATA1($n$) of the present pixel row. Accordingly, an error may be decreased by recalculating the coupling capacitance based upon the compensated grayscale data DATA2($n$) of the present pixel row.

A feedback into the coupling capacitance calculating unit 330, and recalculating the coupling capacitance may be repeated. For example, the amount of the feedback and recalculating may be as many as the amount of added line buffers used for the inner storage unit 310. For example, when the amount of the line buffers is two, one feedback may be possible, and when the amount of the line buffers is three, two feedbacks may be possible.

The data driving part 230 converts a data signal provided from the timing controller 210 to an analog data voltage, and outputs the analog data voltage to the data lines DL1, DL2, DL3, . . . DLi (STEP S300).

The gate driving part 250 generates a plurality of gate signals under the control of the timing controller 210, and sequentially provides the gate signals to the gate lines GL1, GL2, GL3, . . . GLm (STEP S500).

According to the present example embodiment, compensated grayscale data, which compensate for the coupling capacitance generated between a pixel electrode and a common electrode, are provided to a data driving part, so that a display quality of a display apparatus may be enhanced. In addition, the data compensating unit includes the bypass unit 370 omitting compensating grayscale data when compensating the coupling capacitance is unnecessary, so that the coupling capacitance is efficiently compensated. Furthermore, the compensated grayscale data of the present pixel row are fed back to the coupling capacitance calculating unit 330 and the coupling capacitance is recalculated, so that an error may be decreased.

According to the above example embodiments, the data compensating unit calculates a coupling capacitance, which is generated with respect to grayscale data variation between adjacent pixel rows, in advance. Then, the compensating unit 300 compensates grayscale data applied to the pixels of the adjacent pixel rows based upon the calculated coupling capacitance, and outputs the compensated grayscale data. Accordingly, the coupling capacitance is removed, so that a deterioration of a display quality such as reddishness, horizontal stripes, crosstalk, etc may be prevented.

The foregoing is illustrative of the present invention and is not to be construed as limiting thereof. Although practical example embodiments of the present invention have been described, those skilled in the art will readily appreciate that many modifications are possible in the example embodiments without materially departing from the novel teachings and advantages of the present invention. Therefore, it is to be understood that modifications to the disclosed example embodiments, as well as other example embodiments, are intended to be included within the scope of the appended claims.

What is claimed is:

1. A method of driving a display panel for displaying an image, the display panel comprising a first substrate, a second substrate and a liquid crystal layer disposed between the first substrate and the second substrate, the first substrate comprising data lines, gate lines crossing the data lines and a plurality of pixels electrically connected to the data lines and to the gate lines, the second substrate comprising a common electrode facing the pixels, the method comprising:

calculating a coupling capacitance generated between the pixels and the common electrode based upon the grayscale data variation between the (n−1)-th pixel row and the n-th pixel row;

outputting compensated grayscale data for an n-th pixel row based upon a grayscale data variation between an (n−1)-th pixel row and the n-th pixel row, while directly outputting the grayscale data of the n-th pixel row when the coupling capacitance is not more than a reference value;

converting the compensated grayscale data to an analog data voltage to output the analog data voltage to the data lines; and outputting a gate signal through the gate lines to provide the gate signal to the display panel, wherein calculating the compensated grayscale data in the n-th pixel row further comprises:

outputting adjusted data of the n-th pixel row based upon a two-dimensional look-up table to which the adjusted data of the n-th pixel row corresponding to the coupling capacitance and the grayscale data of the n-th pixel row are mapped; and subtracting the adjusted data from the grayscale data of the n-th pixel row when the coupling capacitance has a positive polarity, and by adding the adjusted data to the grayscale data of the n-th pixel row when the coupling capacitance has a negative polarity, wherein the coupling capacitance has a positive polarity when the grayscale data of the n-th pixel row is greater than the grayscale data of the (n−1)-th pixel row, and the coupling capacitance has a negative polarity when the grayscale data of the n-th pixel row is less than the grayscale data of the (n−1)-th pixel row.

2. The method of claim 1, wherein outputting compensated grayscale data in the n-th pixel row further comprises:

storing grayscale data for the (n−1)-th pixel row and the grayscale data for the n-th pixel row; and outputting the compensated grayscale data in the n-th pixel row based upon the coupling capacitance.

3. The method of claim 2, wherein calculating the coupling capacitance comprises:

outputting digital data respectively corresponding to analog data voltages of the grayscale data in the (n−1)-th and n-th pixel rows based upon a one-dimensional look-up table to which the digital data corresponding to the analog data voltages of the grayscale data are mapped;

calculating a sum of the coupling capacitances by summing values of a result from subtracting the digital data of the (n−1)-th pixel row from the digital data of the n-th pixel row in each of the data lines; and dividing the sum by the amount of the data lines and multiplying the divided value by a coupling constant.

4. The method of claim 3, wherein outputting the compensated grayscale data in the n-th pixel row further comprises recalculating the coupling capacitance based upon a feeding back of the compensated grayscale data of the n-th pixel row.

5. The method of claim 4, wherein feeding back the compensated grayscale data of the n-th pixel row and recalculating the coupling capacitance are repeated.

6. A display apparatus comprising:

a display panel configured to display an image comprising:

a first substrate, a second substrate, and a liquid crystal layer disposed between the first substrate and the second substrate, wherein the first substrate comprises data lines, gate lines crossing the data lines and a plurality of pixels, the pixels being electrically connected to the data and gate lines and being arranged in a matrix shape, the second substrate comprising a common electrode facing the pixels;

a timing controller comprising a data compensating unit, the data compensating unit comprising:

a coupling capacitance calculating unit configured to calculate coupling capacitance generated between the pixels and the common electrode based upon the grayscale data variation between the (n−1)-th pixel row and the n-th pixel row; and a bypass unit, the data compensating unit outputting compensated grayscale data in an n-th pixel row based upon a grayscale data variation between an (n−1)-th pixel row and the n-th pixel row, while directly outputting by the bypass unit the grayscale data of the n-th pixel row when the coupling capacitance is not more than a reference value;

a data driving part converting the compensated grayscale data to an analog data voltage, and outputting the analog data voltage to the data lines; and a gate driving part outputting a gate signal to the gate lines, wherein the data compensating unit comprises a data adjusting unit configured to output compensated grayscale data of the n-th pixel row based upon the coupling capacitance and including a two-dimensional look-up table to which the adjusted data of the n-th pixel row corresponding to the coupling capacitance and the grayscale data of the n-th pixel row are mapped, wherein the data adjusting unit calculates the compensated grayscale data of the n-th pixel row, by subtracting the adjusted data from the grayscale data of the n-th pixel row, when the coupling capacitance has a positive polarity and by adding the adjusted data to the grayscale data of the n-th pixel row, when the coupling capacitance has a negative polarity, and wherein the coupling capacitance has a positive polarity when the grayscale data of the n-th pixel row is greater than the grayscale data of the (n−1)-th pixel row, and the coupling capacitance has a negative polarity when the grayscale data of the n-th pixel row is less than the grayscale data of the (n−1)-th pixel row.

7. The display apparatus of claim 6, wherein the data compensating unit further comprises:

an inner storage unit configured to store the grayscale data of the (n−1)-th pixel row and the gray scale data of the n-th pixel row; and a data adjusting unit configured to output compensated grayscale data of the n-th pixel row based upon the coupling capacitance.

8. The display apparatus of claim 7, wherein the coupling capacitance calculating unit comprises a one-dimensional look-up table to which the digital data respectively corresponding to the analog data voltages of the grayscale data in the (n−1)-th and n-th pixel rows are mapped.

9. The display apparatus of claim 8, wherein the coupling capacitance calculating unit calculates the coupling capacitance by summing values resulting from subtracting the digital data of the (n−1)-th pixel row from the digital data of the n-th pixel row in each of the data lines, and by dividing the sum by the amount of the data lines and multiplying the divided value by a coupling constant.

10. The display apparatus of claim 7, wherein the data adjusting unit feeds the compensated grayscale data of the n-th pixel row back to the coupling capacitance calculating unit and recalculates the coupling capacitance based upon the compensated grayscale data of the n-th pixel row.

11. The display apparatus of claim 10, wherein the inner storage unit is a line buffer, and calculating the coupling capacitance is repeated as many as the amount of line buffers.

12. The display apparatus of claim 6, wherein pixels of the (n−1)-th pixel row are electrically connected to first sides of the data lines, and pixels of the n-th pixel row are electrically connected to second sides of the data lines, respectively.

13. The display apparatus of claim 6, wherein the pixels comprise red pixels, green pixels, blue pixels and white pixels.

14. A method for preventing distortion of a common voltage applied to a common electrode of a liquid crystal display panel having a plurality of pixel rows, the method comprising:

determining a coupling capacitance between pixel electrodes to which grayscale data is applied and a common electrode facing the pixel electrodes, based upon grayscale data variations between the pixel electrodes of a n-th pixel row and the common electrode and between pixel electrodes of a (n−1)-th pixel row and the common electrode; and adjusting the grayscale data to be applied to the n-th pixel row based upon the coupling capacitance, while directly outputting the grayscale data of the n-th pixel row when the coupling capacitance is not more than a reference value, wherein adjusting the grayscale data in the n-th pixel row further comprises:

outputting adjusted data of the n-th pixel row based upon a two-dimensional look-up table to which the adjusted data of the n-th pixel row corresponding to the coupling capacitance and the grayscale data of the n-th pixel row are mapped; and subtracting the adjusted data from the grayscale data of the n-th pixel row when the coupling capacitance has a positive polarity, and by adding the adjusted data to the grayscale data of the row when the coupling capacitance has a negative polarity, wherein the coupling capacitance has a positive polarity when the grayscale data of the n-th pixel row is greater than the grayscale data of the (n−1)-th pixel row, and the coupling capacitance has a negative polarity when the grayscale data of the n-th pixel row is less than the grayscale data of the (n−1)-th pixel row.

* * * * *